US005588374A

United States Patent [19]

Urbach

[11] Patent Number: 5,588,374

[45] Date of Patent: Dec. 31, 1996

[54] TRANSPORT AND STORAGE SYSTEM AND APPLICABLE SUPPORT AND MOUNTING EQUIPMENT

[75] Inventor: Dieter Urbach, Grünwald, Germany

[73] Assignee: Oeco-Team Unfernehmens-und Umweltberatung GmbH, Grunwald, Germany

[21] Appl. No.: 78,278

[22] PCT Filed: Jan. 28, 1992

[86] PCT No.: PCT/EP92/00176

§ 371 Date: Aug. 16, 1993

§ 102(e) Date: Aug. 16, 1993

[87] PCT Pub. No.: WO93/08088

PCT Pub. Date: Apr. 29, 1993

[30] Foreign Application Priority Data

Oct. 22, 1991 [DE] Germany ..... 41 34 849.4
Nov. 12, 1991 [DE] Germany ..... 41 37 166.6

[51] Int. Cl.[6] ..... B65D 19/12

[52] U.S. Cl. ..... 108/56.3; 108/51.1

[58] Field of Search ..... 108/56.1, 56.3, 108/51.1, 51.3

[56] References Cited

U.S. PATENT DOCUMENTS

| | | | |
|---|---|---|---|
| 3,123,020 | 3/1964 | Voissem | 108/56.3 X |
| 3,598,065 | 8/1971 | Young | 108/56.3 X |
| 3,610,172 | 10/1971 | Wharton | 108/56.3 X |
| 3,691,964 | 9/1972 | Larson et al. . | |
| 3,804,032 | 4/1974 | Baucom . | |
| 3,910,202 | 10/1975 | Skahan . | |
| 3,915,099 | 10/1975 | Wies et al. . | |
| 4,425,852 | 1/1984 | Riviere | 108/56.3 |
| 4,671,188 | 6/1987 | Beto et al. | 108/56.3 |
| 5,193,464 | 3/1993 | Morden | 108/56.3 |

FOREIGN PATENT DOCUMENTS

| | | | |
|---|---|---|---|
| 2109192 | 5/1972 | France . | |
| 2123455 | 9/1972 | France . | |
| 2160442 | 6/1973 | France . | |
| 2411136 | 8/1979 | France | 108/56.3 |
| 2203504 | 8/1972 | Germany | 108/56.3 |
| 1317703 | 5/1973 | United Kingdom . | |

*Primary Examiner*—Jose V. Chen
*Attorney, Agent, or Firm*—Fliesler, Dubb, Meyer & Lovejoy LLP

[57] ABSTRACT

This pertains to a transport and storage system (1) that has a mounting apparatus, preferably in the form of a pallet and a support apparatus usually consisting of several support footings (3). The support footings have a lower shoulder (5) and an upper shoulder (4) that have at least one flexible, removable lip (10, 11) in an area situated above the feed opening (8) of the lower shoulder (5).

59 Claims, 12 Drawing Sheets

TRANSPORT AND STORAGE SYSTEM AND APPLICABLE SUPPORT AND MOUNTING EQUIPMENT

A transport and storage system for goods, as well as support apparatus and a mounting apparatus for such a system. The invention particularly relates to footings useful in such systems and apparatus.

BACKGROUND OF THE INVENTION

A corresponding system similar to this type of transport and storage system is well-known from French patent publication FR-A-2 123 455. This transport and storage system involves pallet equipped with numerous footings. Because of its design, the footing can only be inserted into corresponding recesses defined at the goods receiving surface of the board. For this purpose, two detached shoulders are provided. The lower of the two shoulders contains a beveled stop surface and a recess. The upper shoulder of the two, which is attached to the upper edge of the footing at a distance equivalent to the thickness of the pallet to the lower shoulder, is a closed continuous ring and/or flange, which lies on the support surface of the pallet when the footing is mounted.

Analyses conducted pursuant to this invention demonstrated that a transport and storage system of the above type suffers from numerous detriments. Basically and by way of example, removal of the footings from the is not possible as the closed upper flange does not permit removal of a damaged footing. Thus, a transport and storage system of this type results in a number of substantial limitations, especially with regard to the materials used in the mounting equipment and the construction of the footings. Therefore, reutilization of the footings is only possible by destroying the surface of the pallet.

Especially with regard to new refuse removal laws, there is a steadily increasing demand for mounting equipment in the area of transport and storage that is economically and ecologically ideal.

Thus, it is the task of the instant invention to create a transport and storage system that will allow the economical and environmentally acceptable manufacture, utilization and waste management of preferably all types of pallet.

DISCLOSURE OF THE INVENTION

An embodiment of the invention comprises an improvement in a transport and storage system having a goods mounting system and a support apparatus that has at least one support footing and a connection device in the form of two detached shoulders on one of its ends, of the two shoulders, the lower one when attached to the mounting apparatus having a feed opening and a tongue pointing downwards. The improvement comprises attaching the upper shoulder in an area above the feed opening, the upper shoulder having at least one flexible lip that can be flexed from the plane of the upper shoulder.

Another embodiment of the invention comprises a support apparatus for a goods transport and storage system with a goods mounting apparatus with at least one support footing that has a connecting device in the form of a detached upper shoulder and a detached lower shoulder on one of its ends, of these two shoulders, the lower shoulder having a feed opening with a tongue extending downwards when installed on the mounting apparatus.

Still another embodiment of the invention comprises a goods mounting system for a goods transport and storage system with a support apparatus that has at least one support footing that has a connecting device in the form of a detached upper shoulder and a detached lower shoulder on one of its ends, of which the lower shoulder, when mounted, has a feed opening with a tongue extending downwards.

The transport and storage system pursuant to the invention distinguishes itself primarily by the formation of the footing and/or by the formation of the footings of its support apparatus. Because, the upper shoulder of the footings contains at least one flexible lip in an area located above the feed opening that can be flexed upwards or downwards from the plane of the upper shoulder, this results in considerable simplification of installation and removal.

Higher stability and collision absorption capability are among the additional special advantages of the instant transport and storage system. In addition, it is possible to mass produce the system according to the instant invention more cost effectively. Due to its design, it is reusable and recyclable with regard to its individual components and their materials. Other advantages of the transport and storage system pursuant to the instant invention include that it is designed in such a way that there is no danger of injury and that individual adaptability with regard to load requirements and arrangement of the footings is guaranteed.

Another advantage is that the instant transport and storage system offers numerous applications in conjunction with differently designed palette surfaces, for example as a flat or lightweight palette, as a stock disposition or reusable palette, as a two or four way palette, as a cover or double decker palette or even as a case or display palette.

In order to keep installation as simple as possible, the upper shoulder and/or the upper edge can be made very thin and thus flexible and even wall thicknesses of 1 millimeter can suffice.

Furthermore, the instant transport and storage system distinguishes itself by its very low weight, and the low weight and the low volume of the footings contribute to this.

Preferentially, it is possible to use nearly every type of material for the mounting apparatus, such as particle board, wood, (corrugated) paper, pressed paper, metal or even suitable recyclable plastics. Advantageously, the instant system is stackable and thus has a low space requirement.

Another advantage is that the footings of the support apparatus can be reused in a cost effective and time saving manner since they are removable when the mounting apparatus is damaged or even destroyed. The footings can be manufactured using recycled plastic material.

If both shoulders are equipped with at least one flexible lip each, then installation and removal can be accomplished from the load receptacle surface of the mounting apparatus as well as the lower surface attached opposite it. This results in the special advantage that the footings themselves can then be separated from the mounting apparatus when it is loaded with goods. For example, this can become necessary when the goods intake apparatus is installed or when several footings are damaged during operation. It is frequently not possible to unload the goods intake apparatus, for example a flat pallet, to exchange a damaged footing or footings. With the instant transport and storage system invention, however, it is possible to quickly remove damaged footings and replace them with new footings when loaded, as the footings can be fastened from both sides of the goods loading apparatus.

In order to form one lip each in the upper and lower shoulder, they can be slit radially, and the shoulders can be slit on the load side to form the respective lip in a selectable partial area of choice on the load side.

Additional facilitation of installation and removal results—especially with mounting apparatus with reinforcement walls of greater thicknesses—when the upper shoulder has two flexible lips that can be removed upwards and downwards from the plane of the upper shoulder.

The tongues can be formed in an especially simple manner by slots joined to each other. To do this, a slit is made in a radial direction from the exterior edge of the shoulder to the inner edge on a shoulder designed like an annular shaped ring. From there, both other slits connect with the radial slit and run along the interior edge of the upper shoulder on the load side. With this arrangement of slots, two tongues and/or lips are formed that are only connected with the upper shoulder on one end. Thus, the lips are very flexible and easy to remove from the plane of the shoulder. When not under load, the lips return to their neutral position and lie flush with the plane of the upper shoulder. Depending on the width of the radially cut slot, a closed surface of the upper shoulder can thus remain in tact or a large segment shaped part can be formed that reflects the radially cut slot. Preferentially, the edges of the slots and or the rims of the lips and the adjacent material of the footings should be rounded off in order to guarantee complete mobility of the slits even at a minimum slot width.

A body shaped like a truncated cone is an especially preferred design for the footings. With a design of this type, the shoulders are arranged on the upper edge of the body with a larger diameter in a condition to be installed. The upper shoulder butts flush with the upper edge of the footing, while the shoulder running parallel attached below it is affixed at a distance that preferably equates to the wall thickness of the mounting apparatus on which the footing is removably attached.

Typically, the upper edge of the body with the larger diameter is designed in an open manner to create a feed opening that permits the footings to be interlocked if they are to be stacked and stored on the mounting apparatus prior to installation, for example.

The lower smaller edge is sealed with a ground wall that is perforated to form liquid run-off openings.

Additionally, the ground wall of the edge with the smaller diameter of the footing body can contain a concentric feed opening as an especially preferred design form. A feed opening of this type is provided when the footings are to be equipped with a reinforcing pin that can be introduced into the footing from the bottom into the feed opening. Thus, a concentrically arranged reinforcement part is formed that runs all the way to the plane of the upper edge of the footing body. Therefore, any load applied—such as a box—can be applied across a larger surface area and the load mounting can be supported.

Preferably, the reinforcement pins can be attached using a reinforcing bead that extends behind the ground wall. The reinforcing bead anchors elastically after the reinforcing pin is pushed through, securing the reinforcement pin against loss in the footing. This design form also enables disruption free removal of the reinforcement pin, should this ever be necessary.

An alternative design form that is also preferable is to equip the support footing itself in its ground wall with a concentric cylindrical protrusion that projects into the interior. This protrusion can have a ring-shaped reinforcing bead projecting into the interior. With this design, a reinforcement pin that is equipped with a one-piece plate can be outfitted with a ring-shaped groove into which the ring-shaped bead locks when the reinforcement pin is inserted into the support footing. Of course, the design and arrangement of the ring-shaped bead and the ring-shaped groove are tailored to each other in such away that a secure position and alignment of the reinforcement pin inside of the footing is guaranteed.

With the design of the support footing just described, it is also possible to supply a fastening pin and or a fastening capsule for runners or stabilization plates that are equipped with numerous ring-shaped grooves arranged one on top of the other.

This permits fastening runners or stabilization plates of various thicknesses using one single attachment module the ring-shaped grooves of which interact with the ring-shaped bead of the support footing, depending upon the thickness of the runner or plate.

Preferably, the upper surfaces of the upper shoulders are to be equipped with a non-slip surface structure. It is even better yet, however, to equip the outer surface of the ground wall of the footing with a non-slip surface structure in addition.

A ring and/or a ring-shaped prominence that protrudes from the plane of the upper shoulder and/or the exterior surface of the ground wall would be an especially preferred design form for such a non-slip surface structure. Additional improvements can be achieved by attaching numerous concentric ring-shaped prominences. They have the advantage that they are not an obstruction during installation and/or removal of the footing, even under load, since the annular shaped concentric arrangement does not prevent the required rotation during installation.

Additional non-slip surface structures in the form of roughing up the surface, burls, continuation of the reinforcement bands and other methods are also conceivable.

In order to further simplify installation, it is also possible to separate the tongue on the edge facing the body of the footing with a slot. This creates a freely moving tongue similar to the arrangement of the lips. The lean angle of the tongue can also be relatively adapted to the longitudinal axis of the footing body and to its position relative to the feed opening with respect to the installation requirements, in order to achieve problem free installation and removal of the footing on the mounting apparatus.

Another especially preferred design example of the instant invention for a transport and storage system has two tongues on the lower edge of the support footing. One of both tongues is the tongue that protrudes downwards which faces another tongue that points upwards. Both tongues are adaptable to the respective application in terms of their length and curvature. The bent tongue of the lower shoulder that faces upwards terminates in the plane of the upper shoulder. It can be connected in one piece with the upper edge as an especially desirable design example, resulting in a continuous surface and/or path. In order to preclude overtightening of the footing during installation, a stopper—preferably in the form of a groove—can be attached on the lower edge in the direction of rotation in front of the upper tongue and pointing toward the upper edge. This design example of the instant transport and storage system is particularly advantageous, since installation and removal of the footing can be done by machine. Both tongues-depending on the direction of rotation during installation and/or removal—create beveled stopping surfaces that simplify "threading" the support footing into the mounting apparatus. The design form with two tongues thus represents a more advantageous form when compared to the design with one tongue, since installation can only be accomplished with a suitable installation machine utilizing the one tongue design.

The mounting apparatus can be made in numerous possible construction styles. As previously mentioned, all types of palettes such as flat pallet, container pallet, box pallet or even pool palettes are feasible. However, it is also possible to attach the footings of the support apparatus to the ground wall of boxes, crates or other containers for parcel service, bulk goods or liquid goods under the condition that seals are installed when receiving liquid goods.

The wall to be equipped with footings of the mounting apparatus (typically the surface of flat palettes) is outfitted with stabilizing recesses that are preferably made as orbicular recesses with a circular shaped segment expansion section. For example, the expansion section can be built using an extension of the radius across from the basic recess and joining sections in the form of tangents to the basic recess. The size of the expansion section and/or the supply area can be chosen based upon the wall thickness of the mounting apparatus. However, in order to guarantee the footings against loss, the size should not exceed an angle range of 90°. The expansion section is shaped like a dove tail in the case of the footing design with a continuous second tongue.

The footings can be joined to each other using reinforcing runners in order to avoid and/or minimize sag of the mounting apparatus wall when being stored in a palette frame, for example. It is also possible to join all footings with a continuous reinforcement plate, thus practically creating a second level parallel to the wall of the mounting apparatus on which the footings of the support apparatus are attached. A supplementary apparatus of this type brings about a considerable increase in stability and prevents jamming of the mounting apparatus during transport on a wheel conveyor by preventing the footings from getting between the wheels of the wheel conveyor.

Reinforcement runners and/or stabilization plates of this type can be attached to the ground wall of the footings using bolt fasteners and/or bolt fastening capsules. The bolt fasteners can also have a stabilizing bead extending behind the ground wall as well as a support flange that reaches behind reaches behind the runner and/or the fastening plate for attachment to the footing when the device is ready to operate.

In addition to the specifically preferred design forms previously mentioned, a design form consisting of a mounting apparatus and a support apparatus that also has at least one support footing is possible as well. Both shoulders of the support footings are each equipped with at least one flexible tongue that can be removed from the plane of the respective shoulder using this especially simple design. The tongues, for example, can be formed with a radial slot and a slot connected to it on the load side. This design is, in fact, not suitable for installation and teardown by machine, but it is quite suitable as an especially cost effective alternative for manual installation and teardown.

A support apparatus and a mounting apparatus for the instant transport and storage system are also set forth and defined as independently functioning devices.

BRIEF DESCRIPTION OF DRAWINGS

Additional details, characteristics and advantages of the invention ensue from the description of design examples for the invention based on the drawing below.

BEST MODE FOR CARRYING OUT INVENTION

Figure 1:
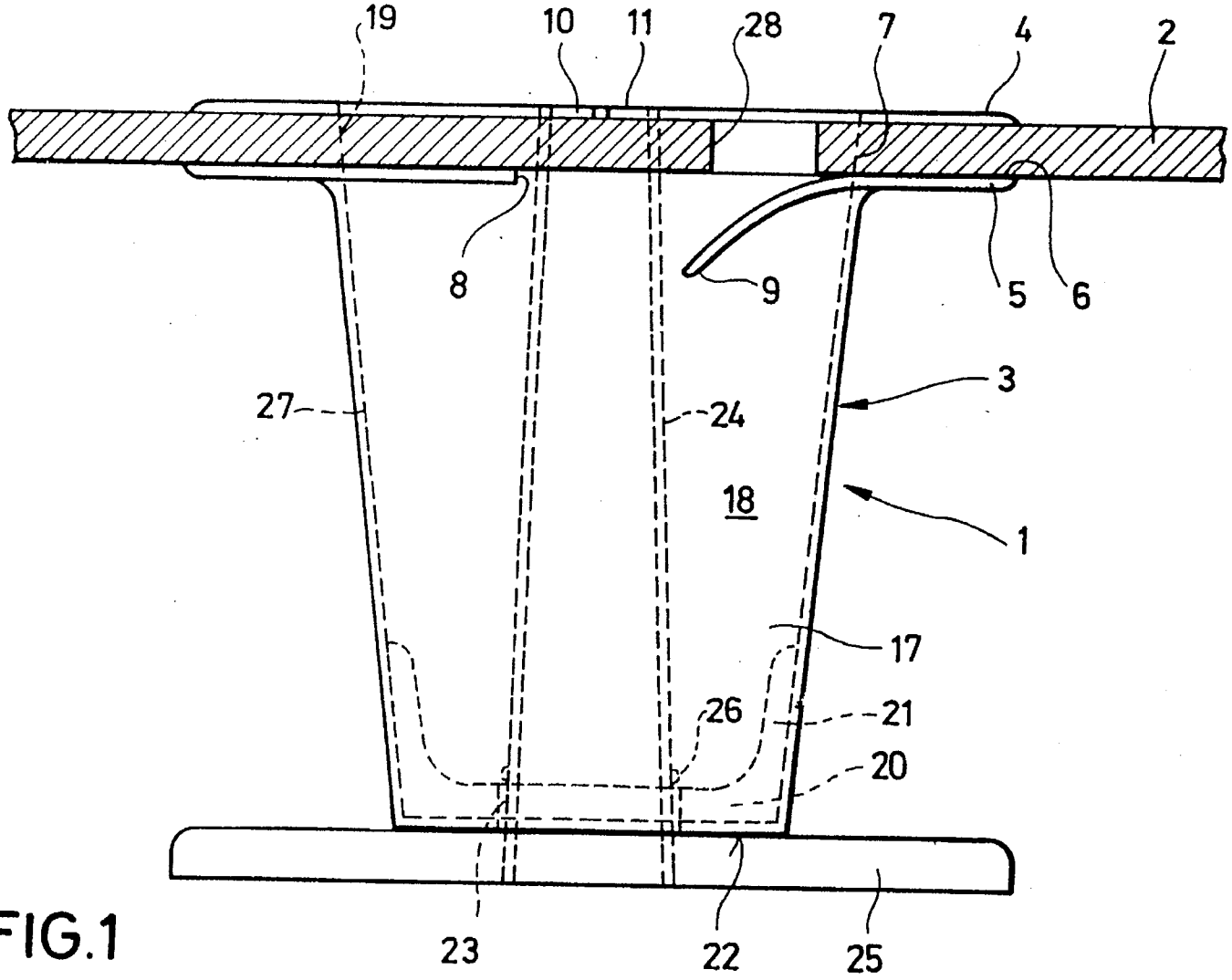
FIG. 1 A schematically somewhat simplified illustration of an initial design of a portion of the instant storage and transport system.

In FIG. 1, a design of a goods conveyance and storage system 1 of the instant invention is illustrated in a somewhat simplified manner. Transport and storage system 1 illustrates in this example a goods mounting apparatus in the form of a flat pallet 2, of which only a portion is illustrated. Flat pallet 2 is equipped with a support apparatus that consists of numerous support footings attached in a user selectable fashion, of which a support footing 3 is representatively depicted in FIG. 1. Basically, it is conceivable that even only one support footing 3 is provided, depending on the type of the mounting apparatus in a minimal case. Typically, however, numerous support footings 3 that are arranged at a distance from each other, primarily in the case of pallet, are provided. This makes easy use of forklifts possible, i.e. insertion of forklift prongs into the spaces between the support footings 3.

FIG. 1 illustrates that support footing 3 has a connecting mechanism on its top end in the form of two spread shoulders and/or flanges 4 and 5 in the readiness condition depicted in 1. Flanges 4 and 5 enclose circular space 6 which is bordered on the inside by partition 7, while it is open on the radial outermost side. FIG. 1 illustrates that pallet 2 extends into space 6 to anchor support footing 3.

The lower shoulder 5 illustrated in the installation condition in FIG. 1 depicts feed opening 8 which has a tongue 9 pointing downwards attached to its one end. As FIG. 1 illustrates, tongue 9 is attached to the plane of shoulder 5 at an obtuse angle, resulting in a beveled stopping surface that terminates in supply opening 8.

In the instant example, the upper shoulder 4 shows two lips 10 and 11 in an area situated above the supply opening 8. When not under load, lips 10 and 11, which are flexibly designed, are attached on the plane of the upper shoulder 4; that is, they rest on the surface of pallet 2 as does the remaining area of upper shoulder 4 when installed.

Figure 2:
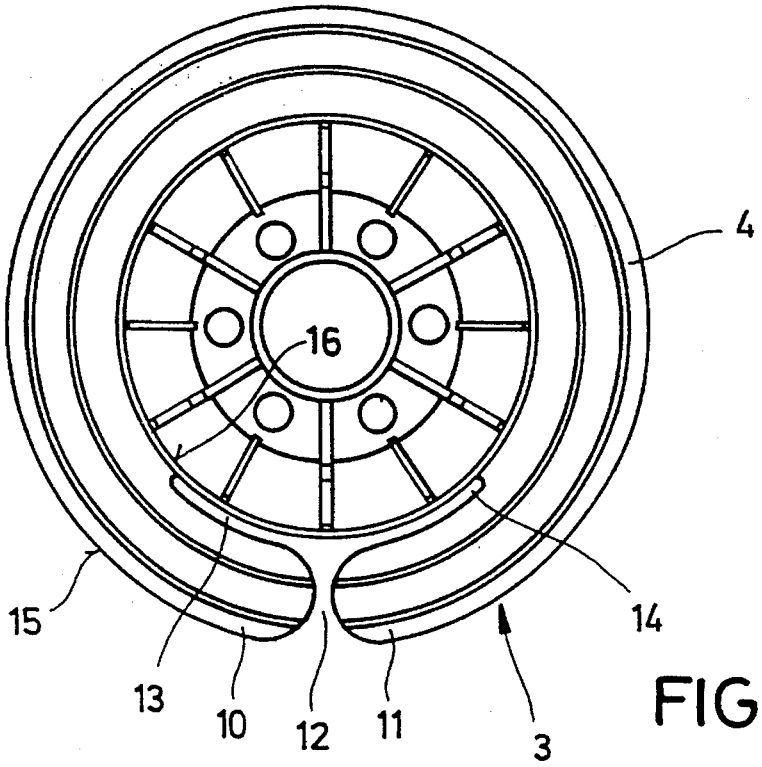
FIG. 2 A simplified illustration based on FIG. 1 of the top view of the upper edge of a footing of the design according to FIG. 1.

As the top view of FIG. 2 illustrates, lips 10 and 11 are formed by attaching three slots, 12, 13 and 14. Due to the annular shaped ring design of shoulders 4 and 5, slot 12 extends radially from the outer edge 15 of shoulder 4 into the area of interior edge 16. As FIG. 2 illustrates, slots 13 and 14 connect with slot 12 and extend along interior edge 16 on the load side. This results in a configuration similar to the letter y. Thus, lips 10 and 11 meld into shoulder 4 on the ends opposite slot 12 on the load side. The extension of shoulder 4 is only slightly interrupted by slot 12 in the design example illustrated in FIG. 2. Nonetheless, this results in a very flexible design for lips 10 and 11 which permits problem free removal from the plane of shoulder 4. This pliability is primarily of great benefit for the installation and removal of footing 3 on mounting apparatus 2. The edges of juxtaposed lips 10 and 11 are beveled.

The slightly conical truncated cone shaped design of its body 17 illustrated in FIG. 1 is an especially preferred form for the footing. Body 17 has a hollow interior 18 which has an opening 19 on its upper side. The footings can be stacked in an interlocking manner through opening 19 and display a serial support band 21 in the area of ground wall 20, upon which the ground wall 20 rests on its respective exterior surface 22.

The ground wall 20 be equipped with a perforation that is not visible in FIG. 1, through which liquids such as water can flow when necessary. The design illustrated in FIG. 1 also shows a concentric feed opening 23 that is attached in the middle of the ground wall 20. In the case of the design illustrated in FIG. 1., a truncated cone shaped reinforcement pin 24 is inserted into the interior space 18 in order to stabilize body 17 of footing 3. The reinforcement pin extends to the plane of the upper edge of shoulder 4. Thus, goods placed on shoulder 4 can be further reinforced with reinforcement pin 24.

In the case of the design illustrated in FIG. 1, reinforcement pin 24 is connected to supporting plate 25. Reinforcement pin 24 also displays a support bead 26, which extends behind ground wall 20 installed and thus protects reinforcement pin 24 from loss in the installation position illustrated in FIG. 1.

The interior surface of body 17 of footing 3 is also outfitted with numerous reinforcement rings that traverse the entire height.

Finally, FIG. 1 shows that the mounting apparatus has at least one stabilization recess 28 per footing. The shape and arrangement of the stabilization recess 28 will be individually explained in conjunction with FIGS. 7 and 8 below.

Figure 3:
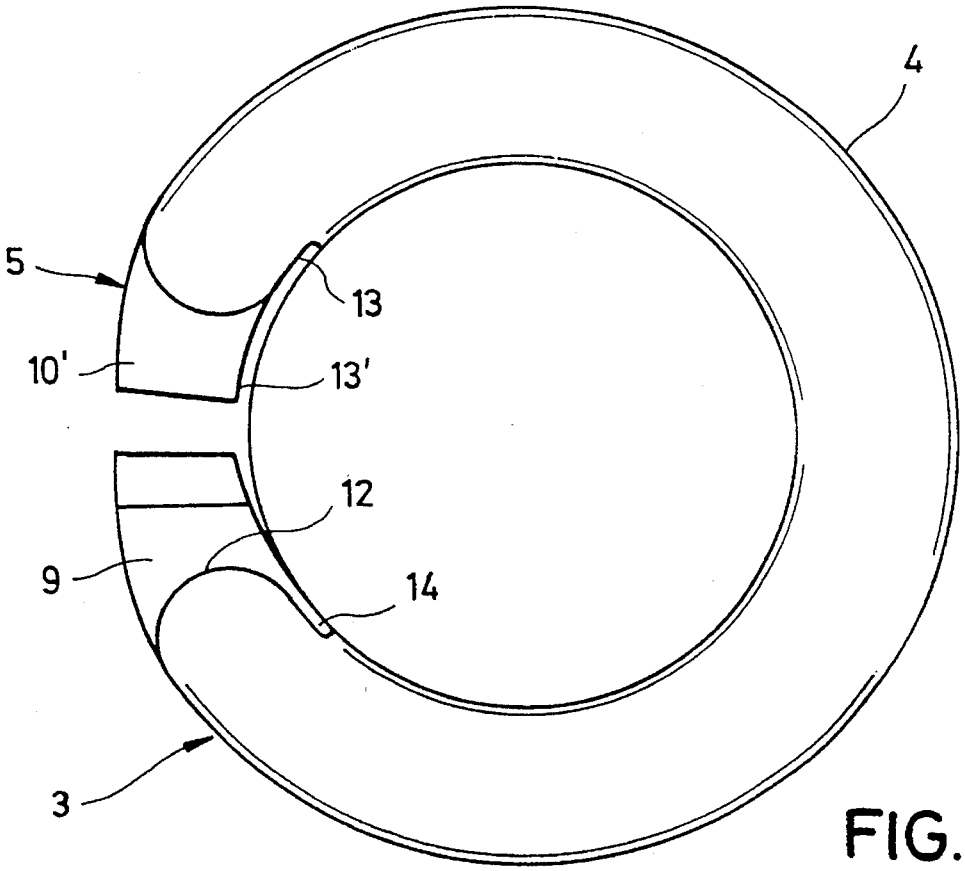
FIG. 3 An illustration according to FIG. 2 of an alternative design of the upper edge of a footing of the transport and storage system.
Figure 4:
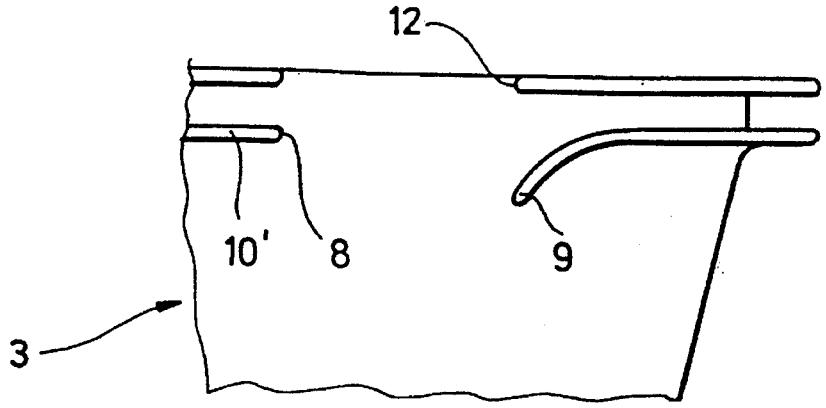
FIG. 4 A partial side view of the upper edge of the footing according to FIG. 3.

FIGS. 3 and 4 show a top view of an alternative design of shoulder 4 of footing 3. The difference consists of an enlargement and/or expansion of slot 12 to a segment shaped opening, which preferably consists of an angle range of 35° from interior edge to interior edge. Otherwise, the design is equivalent with regard to the arrangement of additional slots 13 and 14 to the one illustrated in FIGS. 1 and 2, so that the preceding elaboration can be referred to in this context. FIG. 3 also illustrates that the lower shoulder 5 can have a flexible lip 10'. This lip is made with a slot formation like lips 10 and 11, and only an additional slot 13' along the exterior surface of the footing is necessary according to feed opening 8.

Figure 5:
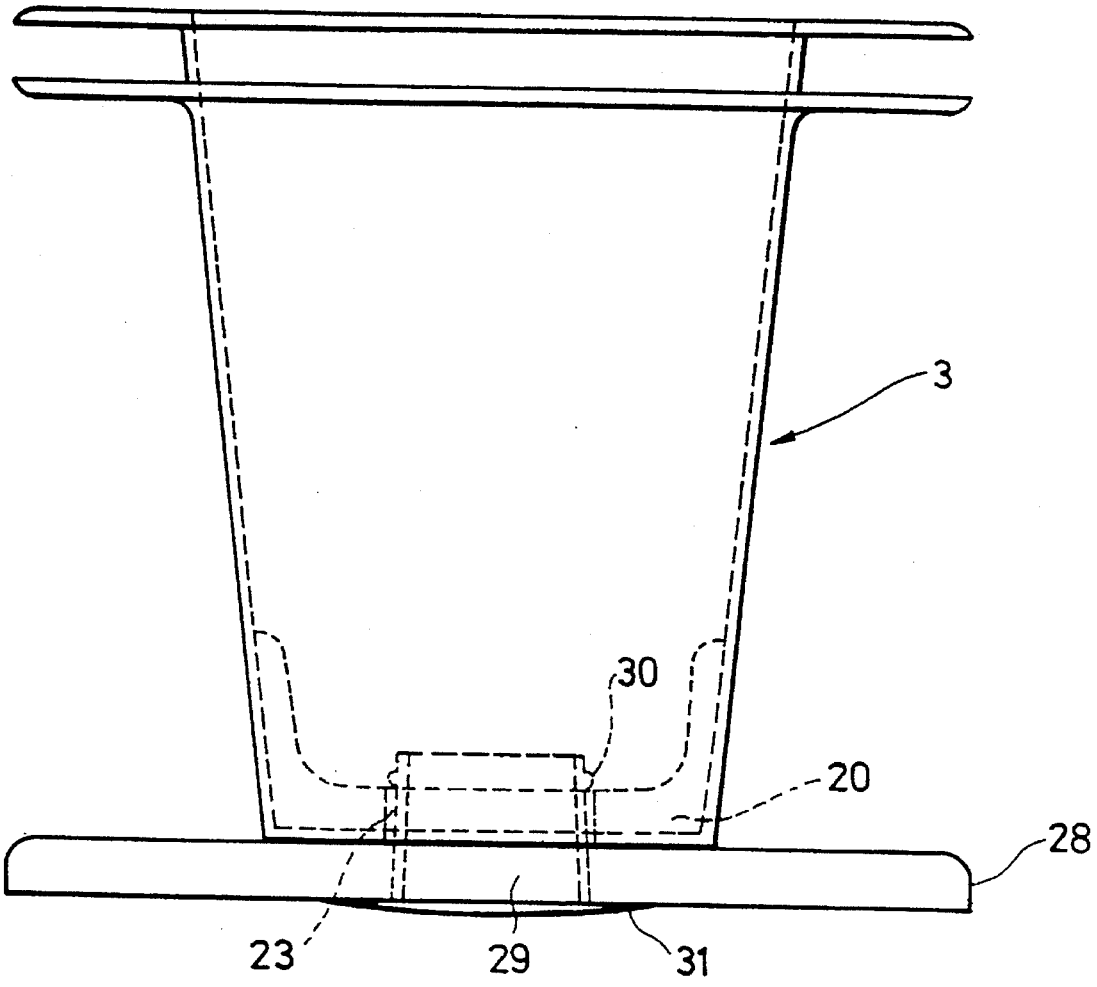
FIG. 5 An illustration of the footing of the instant transport and storage system with attached stabilization runners and/or stabilization plate according to FIG. 1.

An additional variation is illustrated in FIG. 5, where footing 3 is equipped with a reinforcing runner and or a reinforcing plate 28 according to FIG. 1. For this purpose, a bolt fastener 29 which also has a reinforcing bead 30, is introduced into the concentric feed opening 23. The bolt fastener extends behind ground wall 20 as illustrated in FIG. 5 when installed. The bolt fastener 29 also has a protruding edge flange 31 that extends beyond it to mount the runner and/or stabilization plate 28 and thus attaches them to the exterior surface of ground wall 20 of footing 3. Runners and/or stabilization plates of this type increase the overall stability of the transport and storage system 1 to prevent sag in elevated shelf storage for pallet or to prevent footing 3 from sliding in between the wheels of wheel conveyors.

Figure 6A:
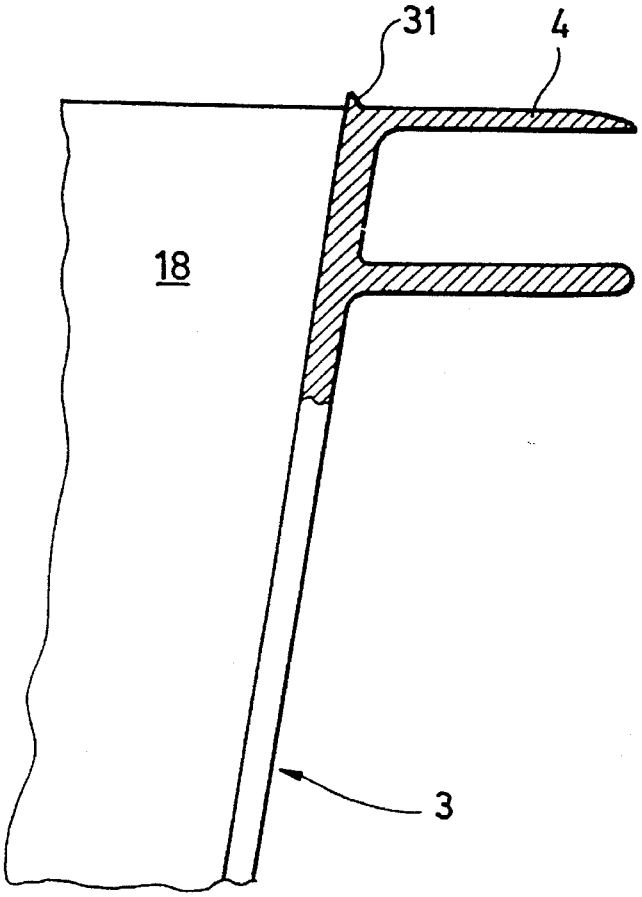
FIGS. 6A through 6C: Schematically simplified illustration of non-slip surface structures for the footing of the instant transport and storage system.
Figure 6B:
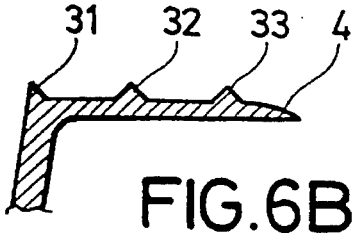
Figure 6C:
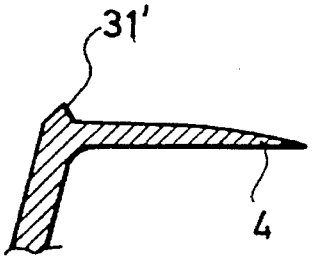

Different design examples for non-slip surface structures of shoulder 4 are illustrated in FIGS. 6A through 6C. The design example in FIG. 6A involves a continuous annular shaped prominence 31 which is attached to the interior edge of shoulder 4 in the transition area to interior space 18 of footing 3.

The design example in FIG. 6B provides three annular shaped prominences (31 through 33) of this type to create the non-slip surface structure. The prominences are arranged concentrically to each other. This arrangement offers the advantage that the non-slip surface structure does not prevent a turning motion of footing 3 for installation on the mounting apparatus.

An alternative design example of a ring-shaped prominence 31' that is beveled on the part that abuts interior space 18 is depicted in FIG. 6C.

Basically, additional design examples such as star shaped or spiral shaped arrangements of prominences and/or bands or even hurls are feasible. The exterior surface 22 of ground wall 20 of footing 3 can be designed in a similar fashion.

In any case, placing a carton on the mounting apparatus 2 in the area of shoulder 4 results in the carton and/or the goods being slightly pushed in, and this prevents undesirable movements.

Figure 7:
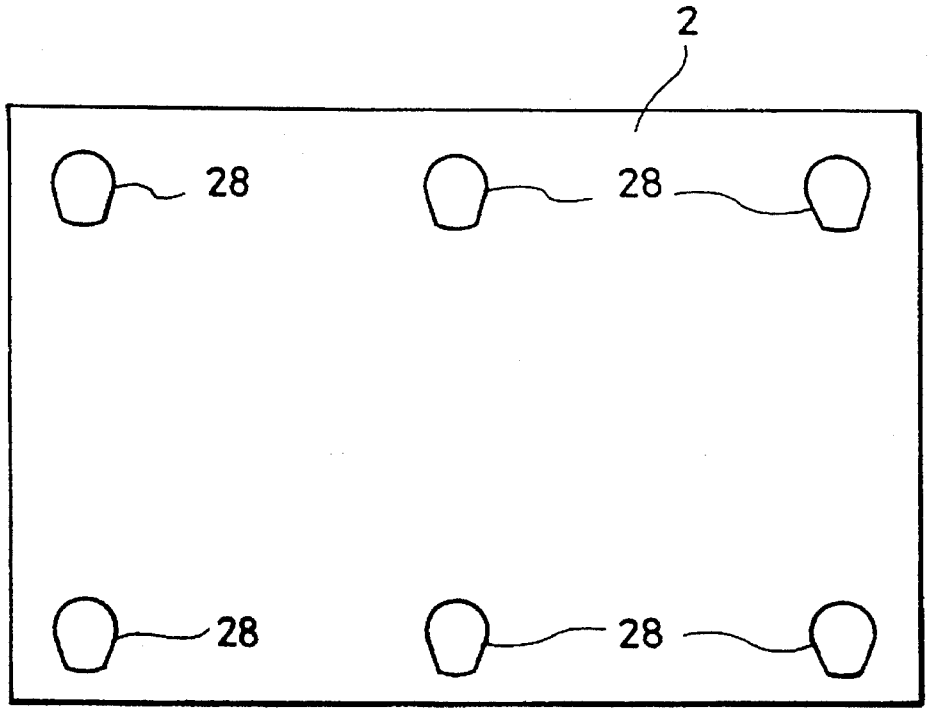
FIG. 7 A top view of a design of a mounting apparatus in the form of a flat pallet.

In FIG. 7, a top view of the mounting apparatus in the form of the pallet 2 depicted in FIG. 1 is illustrated. In this design example, pallet 2 has a total of nine stabilization recesses 28 that are all identically designed. However, other arrangement patterns are feasible, depending upon the type of application and the design form of mounting apparatus 2.

Figure 8:
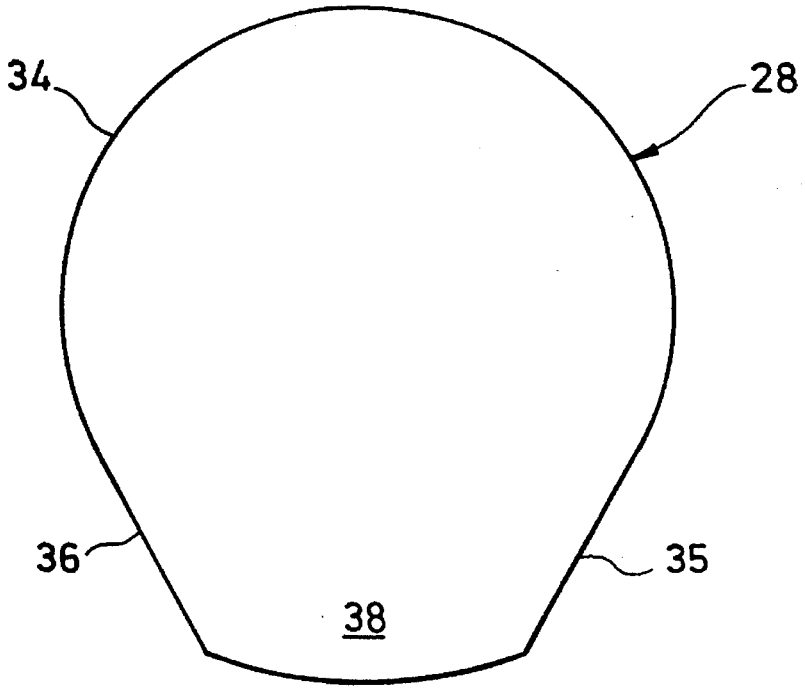
FIG. 8 A schematically simplified illustration of a design of a supply opening of the mounting apparatus of the instant transport and storage system.

FIG. 8 illustrates the individual configuration of stabilization recess 28. Stabilization recess 28 shows a segment 34 in the form of a half or three quarter circle, to which two tangents 35 and 36 are connected. The tangents terminate in a circular segment 37 which has a greater diameter than segment 34. This results in the design similar to a light bulb visible in FIG. 8 with a feed area 38 that can cover a segment area up to a maximum of 90°, depending upon plate thickness.

Either the feed opening 8 with tongue 9 or the area of lips 10 and 11 is utilized to attach one or several footings 3 to the mounting apparatus 2. This makes attachment possible from the load mounting surface or from the bottom of pallet 2. Due to the flexible design of tongue 9 and lips 10 and 11, installation and removal are possible without any problems, even when the load mounting apparatus 2 is under load.

Figure 10:
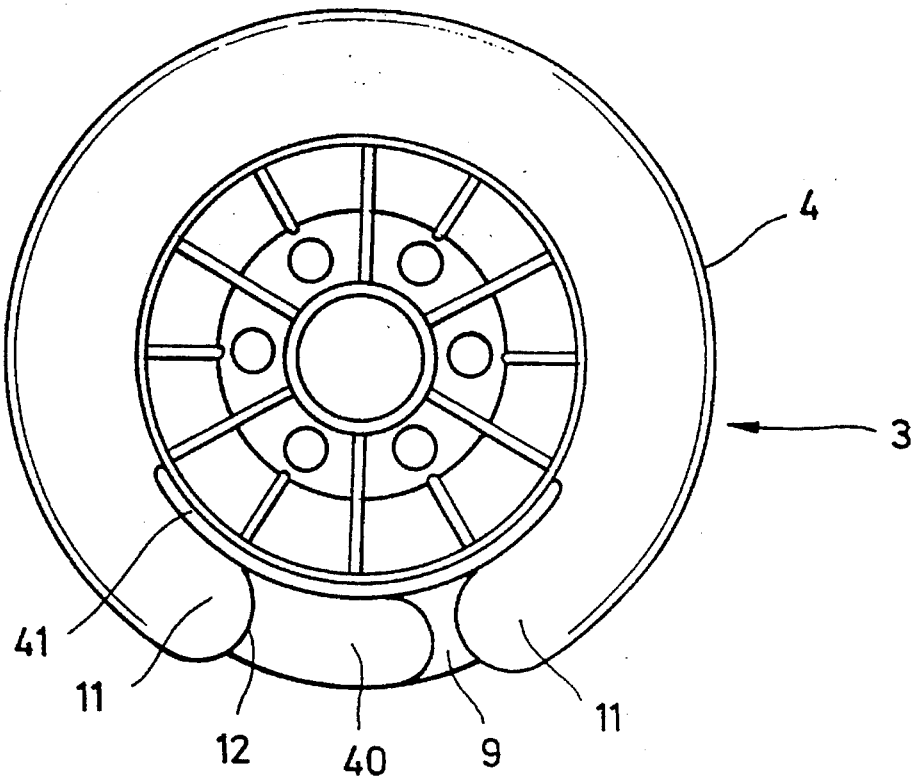
FIG. 10 A top view of the support footing according to FIG. 9.
Figure 9:
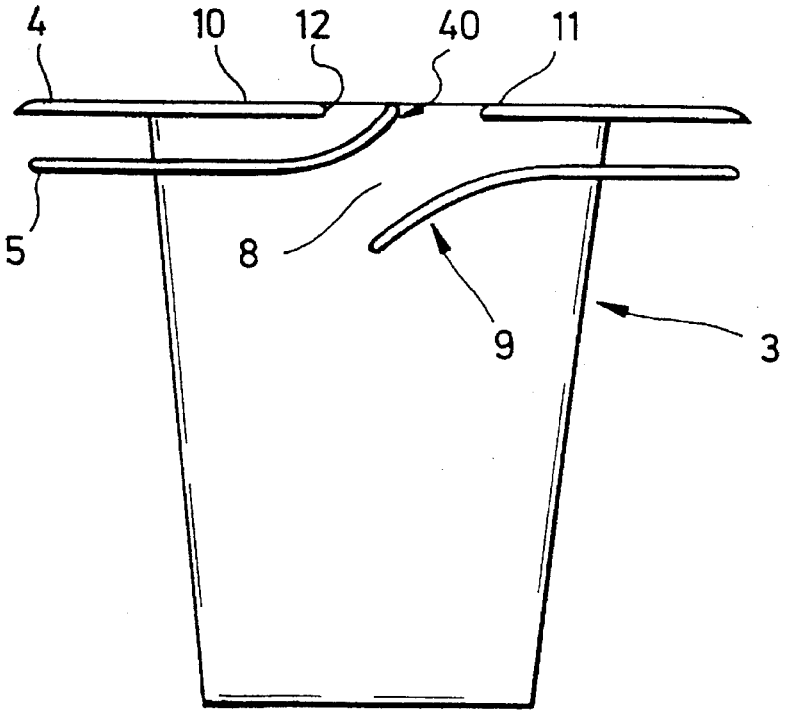
FIG. 9 A schematically quite simplified illustration of an additional design of the support footing of the instant transport and storage system.

An additional alternative design example of a support footing for the instant transport and storage system is illustrated in FIGS. 9 and 10. The support footing illustrated in FIGS. 9 and 10 is also designated by reference symbol 3. All parts corresponding to the previous design examples are identified with the same reference symbols in FIGS. 9 and 10.

The design examples shown in FIGS. 9 and 10 differ from the preceding design examples by the provision of a second tongue 40. The second tongue 40 is also formed on shoulder 5, i.e. the lower shoulder. As shown in FIG. 9, it extends into the plane of upper shoulder 4. The second tongue 40 is bent and flexible as is tongue 9. Tongue 40 is formed on the slotted edge adjacent to the exterior surface of the body of support footing 3. FIG. 10 depicts the placement of the slot identified by reference symbol 41. By virtue of the curvature of the tongues visible in FIG. 9, an approximately parallel arrangement of their terminal areas is created, and feed opening 8 is situated between them in the illustrated design form. Otherwise, FIGS. 9 and 10 illustrate that the design example for this support footing has two lips 10 and 11 of upper shoulder 4 with a relatively broad slot formation for slot 12.

Due to the provision of two tongues 9 and 40, the design example illustrated in FIGS. 9 and 10 is suitable for use with an appropriate installation machine. This applies to installation as well as teardown. Either tongue 9 or tongue 40 would function as a beveled stopping surface in this context (depending upon direction of rotation) upon which the surface of a pallet in the area of the feed opening would strike.

Figure 11:
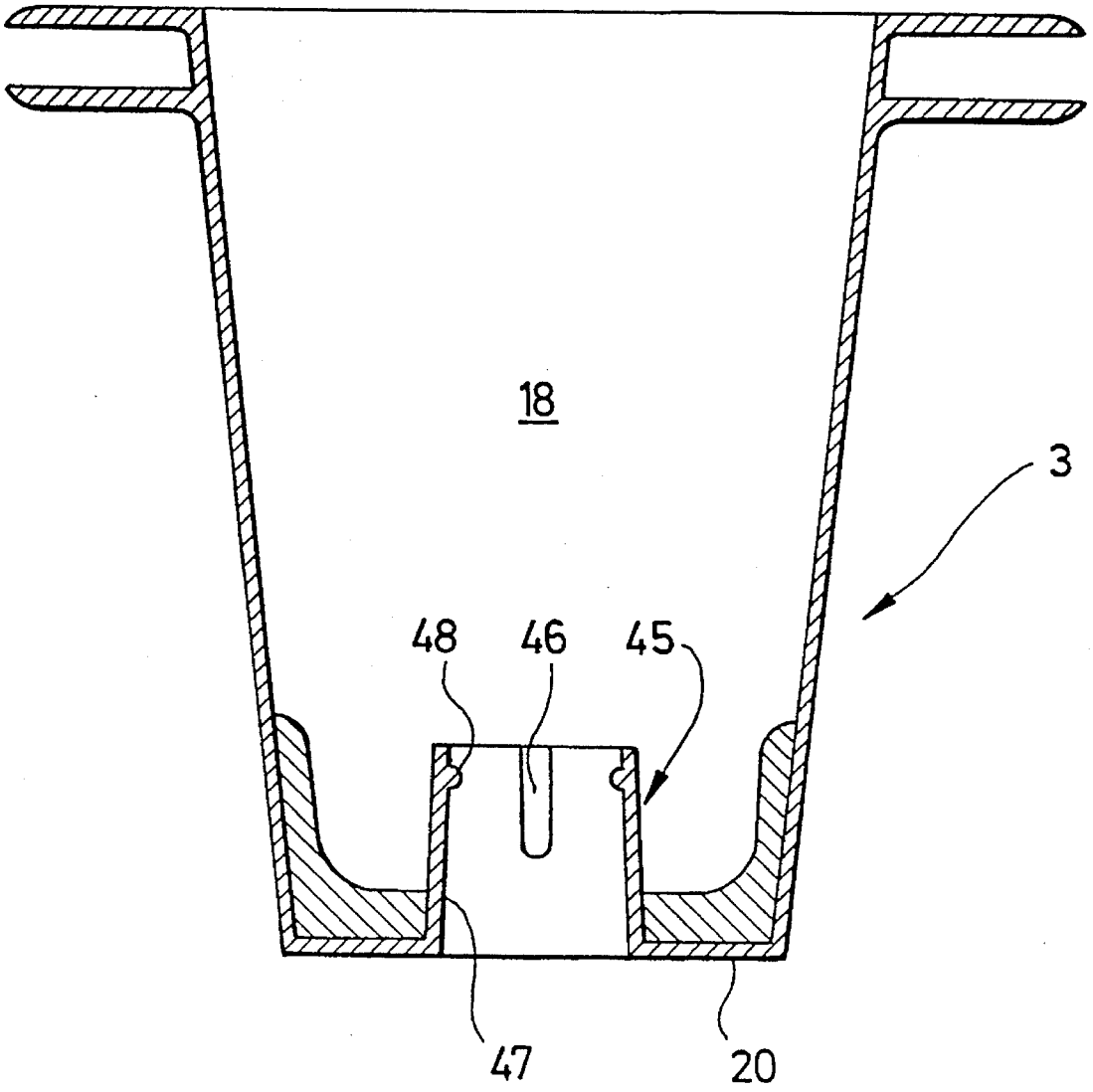
FIG. 11 A lengthwise section of an additional design of a support footing.

In FIG. 11, an additional alternative design example of a support footing for the instant transport and storage system is illustrated. It is also identified by reference symbol 3. Support footing 3 has a stand 45 pursuant to the design example in FIG. 11 which is connected with ground wall 20 as one piece in this example. The stand 45 extends as a concentrically arranged part into the interior room 18 of support footing 3. The stand 45 is basically constructed as a hollow cylinder and has a slot arrangement 46 to increase the flexibility of its walls. The slot arrangement can, for example, be fashioned as cross-point slots. Stand 45 is equipped with a continuous ring bead 48 on its interior wall 47. The height of ring bead 48 can be selected in accordance with the shape of the footing.

Figure 12:
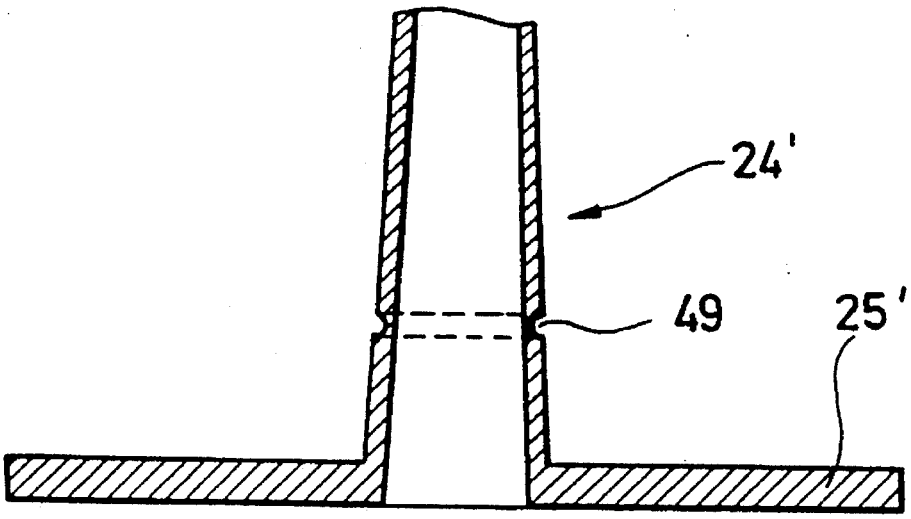
FIG. 12 A side view of an additional design of a reinforcement pin for a support footing of the instant transport and storage system.
Figure 14:
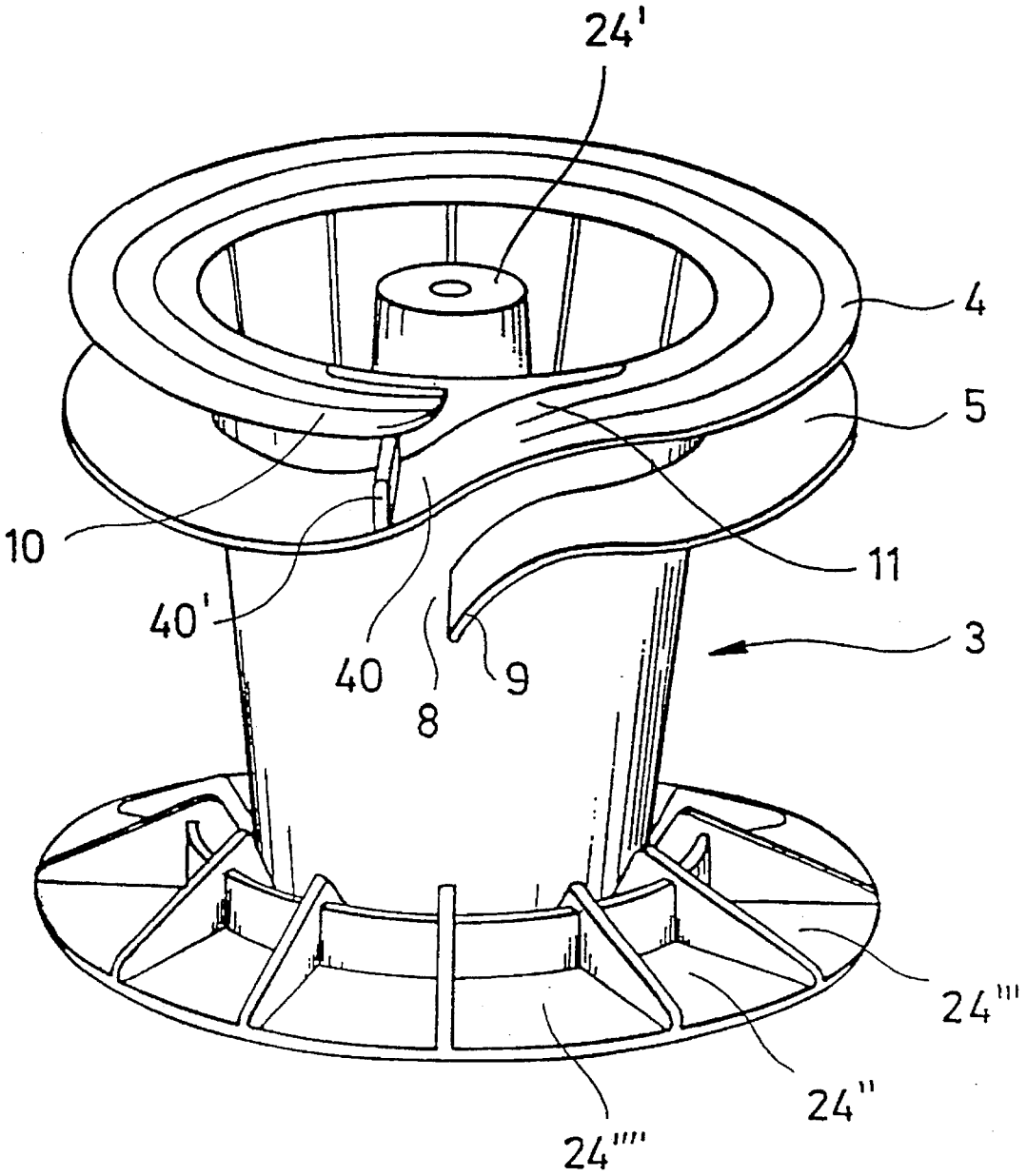
FIG. 14 An illustration of another design of a support footing with a reinforcement pin installed according to FIG. 12, in perspective.

FIG. 12 illustrates an alternative form for reinforcement pin 24', which is basically constructed like reinforcement pin 24 and, accordingly, can also be equipped with a support plate 25'. By contrast with reinforcement pin 24, reinforcement pin 24' of the design example shown in FIG. 12 has a circular groove 49. As FIG. 14 illustrates, circular groove 49 interacts with bead 48 to attach reinforcement pin 24' securely against loss, yet removable, in support footing 3. Of course, the mounting point of circular groove 49 is adapted to the position of bead 48, as is indicated in FIG. 14.

Figure 13:
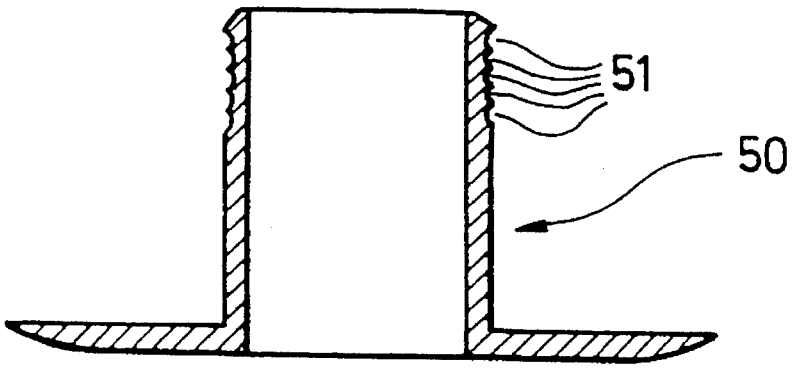
FIG. 13 An illustration pursuant to FIG. 12 of a fastening capsule for the support footing of the instant transport and storage system.

Finally, FIG. 13 shows a mounting capsule 50 that is equipped with numerous circular grooves 51 situated one on top of the other. The circular grooves can also interact with bead 48. Mounting capsule 50 can also be utilized to attach runners or mounting plates as already mentioned in conjunction with FIG. 5 (reference symbol 28 there). The advantage of mounting capsule 50 is that diverse plate thicknesses can be attached to support footing 3 thanks to the number of circular grooves 51. In this instance, circular grooves 51 would interact with bead 48, depending upon plate thickness.

FIG. 14 illustrates an additional preferential design form for a support footing 3 of the support apparatus of the instant transport and storage system. All parts of the support footing corresponding to previous design examples are identified with the same reference symbols. Accordingly, support footing 3 has two shoulders 4 and 5 situated at a distance from each other. Of these two, the upper shoulder 4 has removable, flexible lips 10 and 11 in an area situated above feed opening 8 from the plane of upper shoulder 4 in design example 2. It must be mentioned that lip 10 in the illustrated designed example is separated from the edge of the upper opening of support footing 3 by a slot to achieve flexibility. However, it is also possible—as a general rule—to omit this slot on lip 10. The design example depicted in FIG. 14 is similar in its basic structure to the design form shown in FIG. 9. Accordingly, a second tongue 40 is provided in this design example. Tongue 40 is attached opposite the first tongue 9 and extends into the plane of the upper shoulder 4. By contrast to the design example in FIG. 9, the second tongue 40 is connected in one piece with lip 11 of the upper shoulder 4. Thus, starting with lip 10 of upper shoulder 4 and proceeding across lip 11, tongue 40 and shoulder 5 result in a one piece continuous path all the way to tongue 9. This design example makes it possible to attach support footing 3 to mounting apparatus 2 by rotation in an especially simple way. For this purpose, mounting apparatus 2 is equipped with the previously mentioned feed openings 28 that are equipped with dove tail shaped feed area 38 when used with support footing 3 according to FIG. 14 (see also FIG. 15).

A groove 40' is provided to prevent the support footing 3 from being turned in too far into the stabilization recesses 28 of mounting apparatus 2. The groove is mounted in front of upper tongue 40 on shoulder 5. Groove 40' forms an obstacle that extends from lower shoulder 5 in the direction of shoulder 4. The arrangement and formation of this obstacle groove 40 results from the illustration in FIGS. 14 and 15, which are expressly referred to hereby.

The reinforcement pin 24' illustrated in FIG. 12 is also mounted in the interior of support footing 3 in the design example depicted in FIG. 14.

In this design example, reinforcement pin 24' has an annular shaped plate 24" which is equipped with reinforcement bands 24''' and an edge flange 24''''. The reinforcement bands 24''' are triangular shaped and slope toward the outer edge of plate 24". Express reference is made to the illustration in FIG. 14 for the purpose of disclosing the design and formation of these parts.

Figure 15:
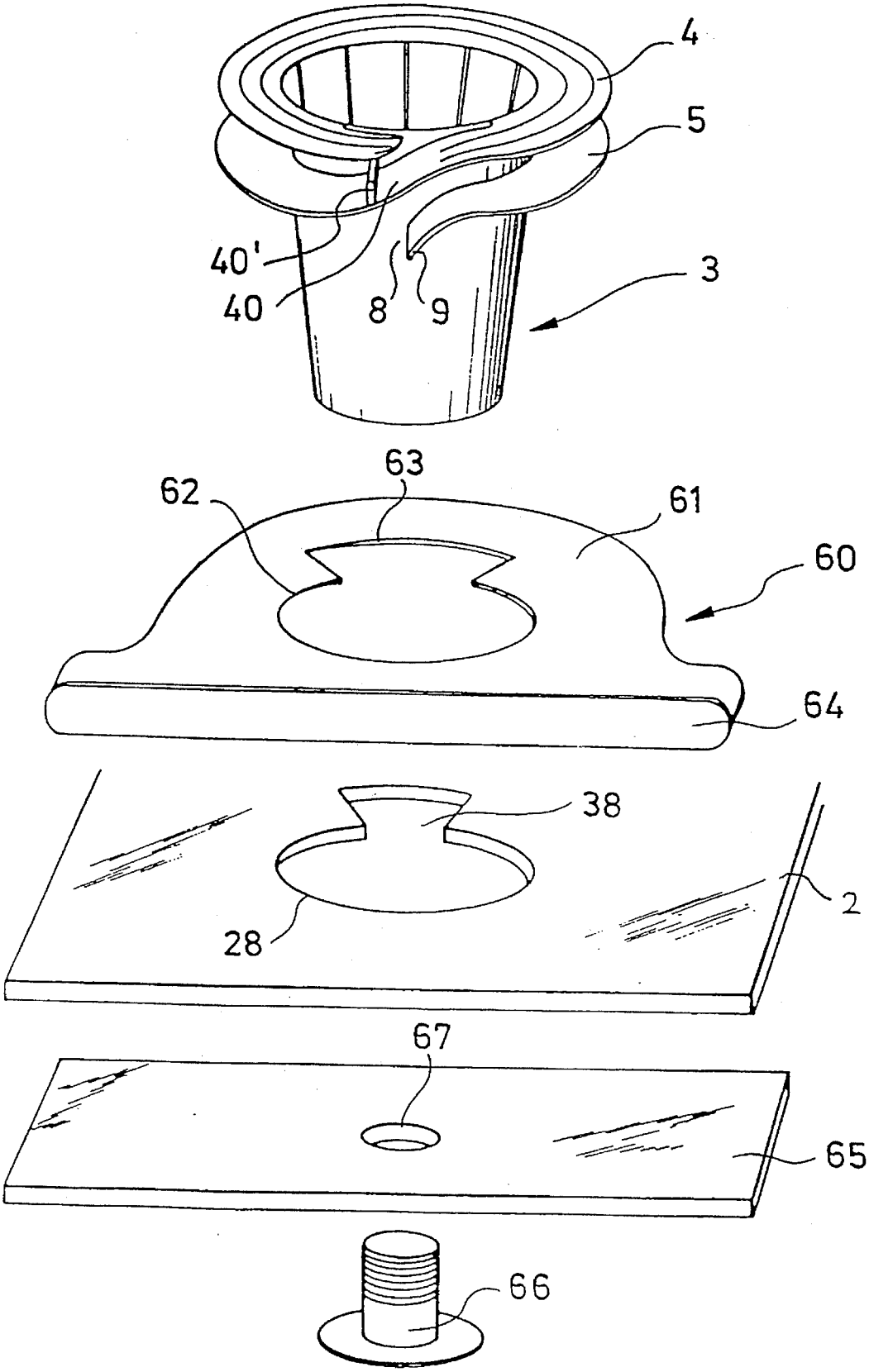
FIG. 15 A sectionalized illustration of the components of a part of an additional design of the instant transport and storage system.

In FIG. 15, a segmented illustration of a part of the instant transport and storage system is depicted to clarify its most important components. Support footing 3 is equivalent to the design example illustrated in FIG. 14 (without reinforcement pins) so that reference can be made to previous explanations. The mounting apparatus 2 in the shape of a pallet shows the previously mentioned stabilization recesses 28 with their dove tail shaped feed areas 38.

In addition, an attachable edge protection and non-slip apparatus 60 is provided. Apparatus 60 shows a plate 61 with a recess 62 and a dove tail shaped area 63 which is equipped with an edge strip 64. The edge strip 64 rises—as illustrated in FIG. 15—bilaterally from the plane of plate 61. Thus, it is possible that the strips of pallet 2 are protected when apparatus 60 is installed and that the part of edge strip 64 that now protrudes past the plane of pallet 2 prevents goods placed on pallet 2 from sliding off.

The design form illustrated in FIG. 15 also shows reinforcement runners 65 that connect the unit formed by mounting apparatus 2 and support footing 3. In the design example illustrated, reinforcement runner 65 is shaped like a strip and has an opening 67 through which the pin of a bolt fastener 66 can be inserted. When installed, the bolt fastener 66 fastens reinforcement runner 65 to palette 2 which interacts with the edge bead 48 of stand 45 (see FIG. 11). Concurrently, the edge protection and non-slip apparatus 60 is attached to palette 2 by mounting support footing 3.

Figure 16:
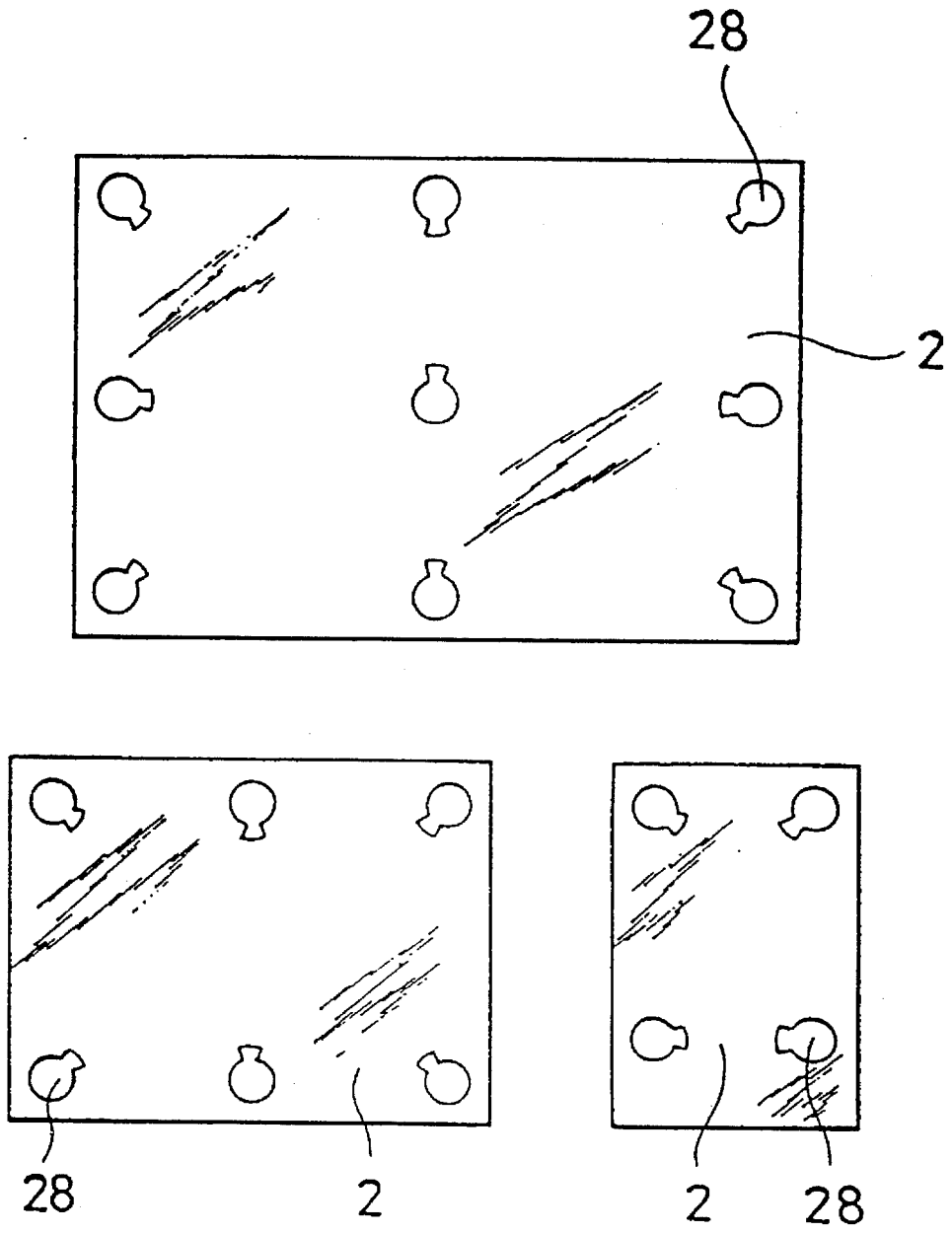
FIG. 16 Top views of additional designs of the mounting apparatus.
Figure 17:
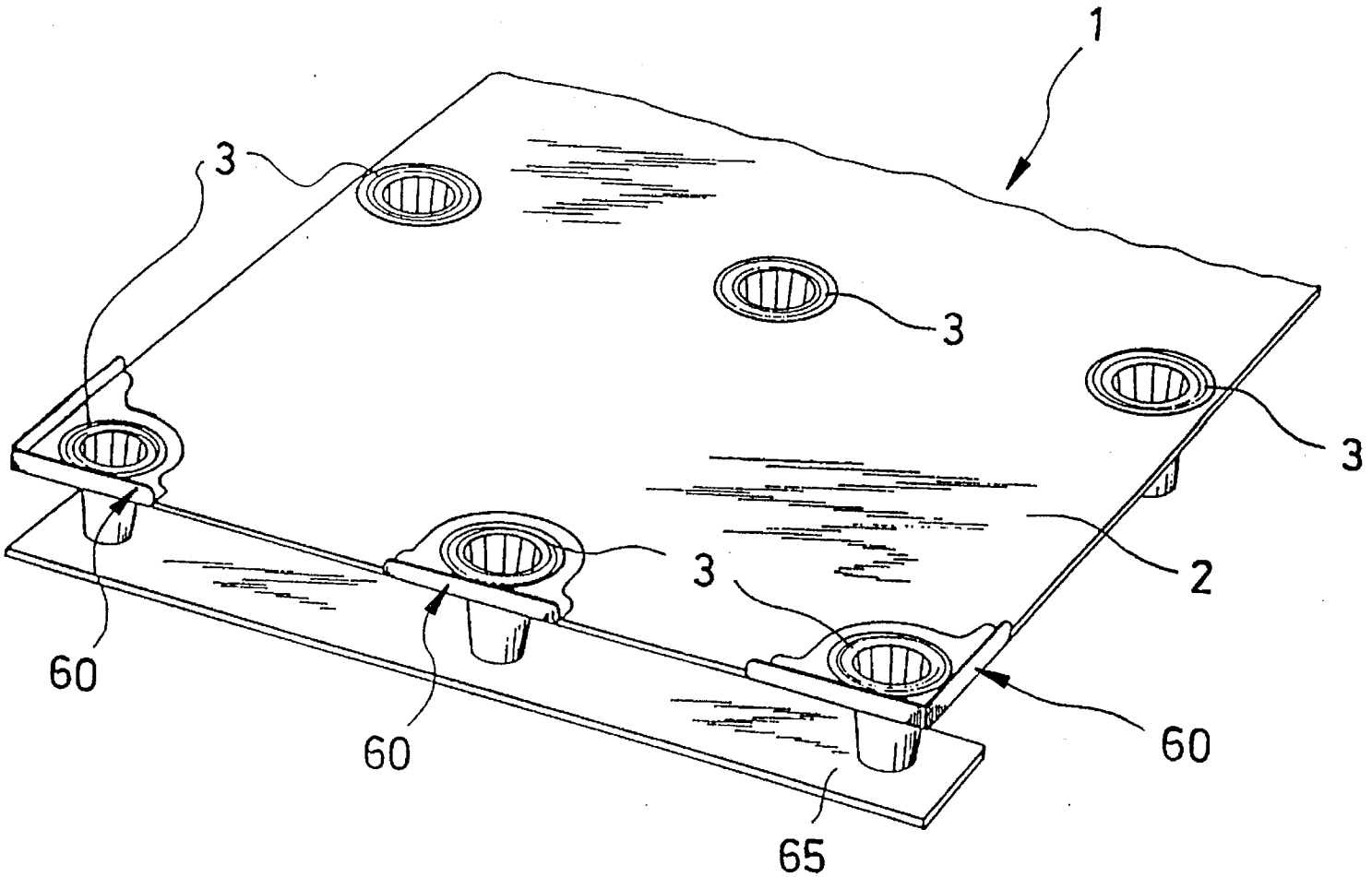
FIG. 17 An illustration of a specially preferred design of the instant transport and storage system in perspective.

FIG. 17 illustrates a completely installed preferential design example of the instant transport and storage system 1 with the individual components elaborated in conjunction with FIG. 15 in an installed state, while FIG. 16 depicts different arrangement patterns for stabilization recesses 28. FIG. 16 is expressly referred to and incorporated by reference for the purpose of disclosing this arrangement pattern.

The mounting apparatus can be fashioned as an aluminum palette in all of the design examples described above. Preferably, an aluminum pallet of this type should be 1 to 5 millimeters thick. Typically, it is equipped with a contour for stability. An aluminum pallet of this type is angled downward from the plane of its extension in the area of the stabilization recesses, resulting in a recess length equivalent to the distance of the upper and lower shoulder of the respective support footings 3 that are to be installed. The edges of the aluminum pallet can also be trimmed, and the amount of trimming should be equivalent to the distance of the upper and lower shoulder of support footings 3.

That which is claimed is:

1. In a transport and storage system (1) having a goods mounting arrangement (2) which includes a support apparatus that has at least one support footing (3) having an upper end and a lower end, the upper end having a connection device in the form of two outwardly extending shoulders (4, 5) which, when attached to the mounting arrangement (2) form an upper (4) and a lower (5) outwardly extending shoulder, the lower shoulder (5) having a feed opening (8) and a downwardly extending tongue (9), the improvement comprising:

wherein the upper shoulder (4) has, in an area above the feed opening (8), at least one flexible lip (10, 11) that can be flexed from an upper plane which includes the upper shoulder (4). wherein the shoulders (4, 5) are made as annular shaped edge strips running parallel to each other with each lid (10, 11) being formed by a slot (12) which runs radially outwardly from the support footing (3), and by another slot (13, 14) which runs along an interior load side (16) of the upper shoulder (4).

2. A transport and storage system pursuant to claim 1 characterized by the lower shoulder (5) having a flexible lip that can be flexed from a lower plane which includes the lower shoulder (5).

3. A transport and storage system pursuant to claim 2, characterized by the lower shoulder (5) having a second tongue (40) which extends upwardly from a base portion thereof located in the plane of the lower shoulder with the base portions of the first and second tongues being mounted directly opposite one another, the second tongue extending upwardly into an upper plane which includes the upper shoulder (4).

4. A transport and storage system pursuant to claim 1 characterized by two lips (10, 11) having facing end portions which are diametrically opposed to one another provided in the area designed above the feed opening (8).

5. A transport and storage system pursuant to claim 4 characterized by shoulders (4, 5) made as annular shaped edge strips running parallel to each other and the lips (10, 11) are formed by three slots (12–14) connected with each other, of which one (12) runs radially, while both other ones (13, 14) run along an interior load side (16) of the shoulders (4).

6. A transport and storage system pursuant to claim 5, characterized by a radial slot (12) that is variable in width.

7. A transport and storage system pursuant to claim 6, characterized by support footings (3) that have a hollow, truncated cone shaped body (17) having a greater diameter end and a lesser diameter end and wherein the shoulders (4, 5) are attached to the greater diameter end of the body (17).

8. A transport and storage system pursuant to claim 7, characterized by the body (17) being equipped with reinforcement beads (27) on its interior surface that extend across the entire height of the body.

9. A transport and storage system pursuant to claim 8, characterized by the greater diameter end being open and the lesser diameter end being closed by means of a circular shaped ground wall (20).

10. A transport and storage system pursuant to claim 9, characterized by the ground wall (20) being perforated to form water drainage openings.

11. A transport and storage system pursuant to claim 1, characterized by support footings (3) that have a hollow, truncated cone shaped body (17) having a greater diameter end and a lesser diameter end and wherein the shoulders (4, 5) are attached to the greater diameter end of the body (17).

12. A transport and storage system pursuant to claim 11, characterized by the body (17) being equipped with reinforcement beads (27) on its interior surface that extend across the entire height of the body.

13. A transport and storage system pursuant to claim 12, characterized by a large diameter edge which is open and a small diameter edge which is closed by means of a circular shaped ground wall (20).

14. A transport and storage system pursuant to claim 13, characterized by the ground wall (20) being perforated to form water drainage openings.

15. A transport and storage system pursuant to claim 1, characterized by the upper surface of the upper shoulders (4) and preferably the exterior surface (22) of the ground wall (20) being equipped with a non-slip surface structure.

16. A transport and storage system pursuant to claim 15, characterized by a surface structure made of concentric ring shaped prominences (31–33).

17. A transport and storage system pursuant to claim 1, characterized by a tongue (9) that is separated from body (17) by a slot on the edge facing its footing body (17).

18. A transport and storage system pursuant to claim 1, characterized by the mounting arrangement (2) being shaped like a flat pallet, a container pallet, a box pallet or a pool pallet, a carton, a box or other container for parcel service, bulk goods or liquid goods.

19. A transport and storage system pursuant to claim 1, characterized by a wall of the mounting arrangement (2) being outfitted with support footings (3) equipped with stabilization recesses (28).

20. A transport and storage system pursuant to claim 19, characterized by stabilization recesses (28) that have a feed area (38) that is preferably shaped like a dove tail.

21. A transport and storage system pursuant to claim 1, characterized by one of a number of support footings (3) that connects a reinforcement runner (28) to a unit consisting of the mounting arrangement (2) and support footings (3) or one stabilization plate that connects all support footings (3) being removably mounted.

22. A transport and storage system pursuant to claim 21, characterized by a plurality of bolt fasteners (29) being provided to attach a corresponding plurality of runners and/or plates (28), the fasteners (29) being mounted in the feed opening (23) of the support footings (3).

23. A transport and storage system pursuant to claim 1, characterized by the lower shoulder (5) having a second tongue (40) which extends upwardly from a base portion thereof located in the plane of the lower shoulder with the base portions of the first and second tongues being mounted directly opposite one another, the second tongue extending upwardly into an upper plane which includes the upper shoulder (4).

24. In a transport and storage system (1) having a goods mounting arrangement (2) which includes a support apparatus that has at least one support footing (3) having an upper end and a lower end, the upper end having a connection device in the form of outwardly extending substantially planar shoulders (4 and 5) which are generally parallel to one another, one of the shoulders (5), when attached to the mounting arrangement (2), forming a lower shoulder (5) and having a feed opening (8) and a downwardly extending tongue (9) which extends downwardly from the a base portion thereof in the plane of the lower shoulder, the improvement comprising:

wherein the other of the shoulders (4) when attached to the mounting arrangement (2) forms an upper shoulder (4) which, in an area above the feed opening (8), has at least one flexible lip (10, 11) that can be flexed from an upper plane which includes the upper shoulder (4), the lower shoulder (5) has a flexible lip that can be flexed from a lower plane which includes the lower shoulder (5); and the two flexible lips of the upper shoulder (4) have facing ends which are diametrically opposed to one another and are provided in the area designed above the feed opening (8), wherein the shoulders (4, 5) are made as annular shaped edge strip running parallel to each other with each lip (10, 11) being formed by a slot (12) which runs radially outwardly from the support footing (3), and by another slot (13, 14) which runs along an interior load side (16) of the upper shoulder (4).

25. A transport and storage system pursuant to claim 24 characterized by the shoulders (4, 5) being made as annular shaped edge strips running parallel to each other with the lips (10, 11) being formed by three slots (12–14) connected with each other, of which one slot (12) runs radially outwardly from the support footing (3), while both other slots (13, 14) run along an interior load side (16) of the upper shoulder (4).

26. A transport and storage system pursuant to claim 24, characterized by a radial slot (12) that is variable in width.

27. A transport and storage system pursuant to claim 26, characterized by support footings (3) that have a hollow, truncated cone shaped body (17) having a greater diameter end and a lesser diameter end and wherein the shoulders (4, 5) are attached to the greater diameter end of the body (17).

28. A transport and storage system pursuant to claim 27, characterized by the body (17) being equipped with reinforcement beads (27) on its interior surface that extend across the entire height of the body.

29. A transport and storage system pursuant to claim 28, characterized by the greater diameter end being open and the lesser diameter end being closed by means of a circular shaped ground wall (20).

30. A transport and storage system pursuant to claim 29, characterized by the ground wall (20) being perforated to form water drainage openings.

31. A transport and storage system pursuant to claim 30, characterized by a ground wall (20) with a concentric feed opening (23).

32. A transport and storage system pursuant to claim 31, characterized by support footings (3) that can be combined with a reinforcement pin (24) that can be introduced through the feed opening (23).

33. A transport and storage system pursuant to claim 32, characterized by a reinforcement pin (24) that is mountable with a reinforcing bead (26, 48).

34. A transport and storage system pursuant to claim 33, characterized by the upper surface of the upper shoulders (4) and preferably the exterior surface (22) of the ground wall (20) being equipped with a non-slip surface structure.

35. A transport and storage system pursuant to claim 34, characterized by a surface structure made of concentric ring shaped prominences (31–33) .

36. A transport and storage system pursuant to claim 35, characterized by the tongue (9) being separated from the body (17) by a slot on an edge thereof facing the body (17).

37. A transport and storage system pursuant to claim 36, characterized by the mounting apparatus (2) being shaped like a flat pallet, a container pallet, a box palette or a pool pallet, a carton, a box or other container for parcel service, bulk goods or liquid goods.

38. A goods mounting system (2) for a goods transport and storage system (1) with a support apparatus that has at least one support footing (3) having an upper end and a lower end, the support footing having a connecting device in the form of an outwardly extending upper shoulder (4) and an outwardly extending lower shoulder (5) on its upper end, the lower shoulder (5), when mounted, having a feed opening (8) with a tongue (9) extending downwards; characterized by the characteristics of claim 37.

39. A transport and storage system pursuant tc claim 37, characterized by a wall of the mounting apparatus (2) being outfitted with support footings (3) equipped with stabilization recesses (28).

40. A goods mounting system (2) for a goods transport and storage system (1) with a support apparatus that has at least one support footing (3) having an upper end and a lower end, the support footing having a connecting device in the form of an outwardly extending upper shoulder (4) and an outwardly extending lower shoulder (5) on its upper end, the lower shoulder (5), when mounted, having a feed opening (8) with a tongue (9) extending downwards; characterized by the characteristics of claim 39.

41. A transport and storage system pursuant to claim 39, characterized by stabilization recesses (28) that have a feed area (38) that is preferably shaped like a dove tail.

42. A goods mounting system (2) for a goods transport and storage system (1) with a support apparatus that has at least one support footing (3) having an upper end and a lower end, the support footing having a connecting device in the form of an outwardly extending upper shoulder (4) and an outwardly extending lower shoulder (5) on its upper end, the lower shoulder (5), when mounted, having a feed opening (8) with a tongue (9) extending downwards; characterized by the characteristics of claim 41.

43. A transport and storage system pursuant to claim 41, characterized by the size of the feed area (38) of the stabilization recess (28) being selectable, depending upon the wall thickness of the mounting apparatus (2).

44. A goods mounting system (2) for a goods transport and storage system (1) with a support apparatus that has at least one support footing (3) having an upper end and a lower end, the support footing having a connecting device in the form of an outwardly extending upper shoulder (4) and an outwardly extending lower shoulder (5) on its upper end, the lower shoulder (5), when mounted, having a feed opening (8) with a tongue (9) extending downwards; characterized by the characteristics of claim 43.

45. A transport and storage system pursuant to claim 43, characterized by one of a number of support footings (3) that connects a reinforcement runner (28) to a unit consisting of the mounting arrangement (2) and support footings (3) or one stabilization plate that connects all support footings (3) being removably mounted.

46. A goods mounting system (2) for a goods transport and storage system (1) with a support apparatus that has at least one support footing (3) having an upper end and a lower end, the support footing having a connecting device in the form of an outwardly extending upper shoulder (4) and an outwardly extending lower shoulder (5) on its upper end, the lower shoulder (5), when mounted, having a feed opening (8) with a tongue (9) extending downwards; characterized by the characteristics of claim 45.

47. A transport and storage system pursuant to claim 45, characterized by a plurality of bolt fasteners (29) being provided to attach a corresponding plurality of runners and/or plates (28), the fasteners (29) being mounted in the feed opening (23) of the support footings (3).

48. A good mounting system (2) for a goods transport and a storage system (1) with a support apparatus that has at least one support footing (3) having an upper end and a lower end, the support footing having a connecting device in the form of an outwardly extending upper shoulder (4) and an outwardly extending lower shoulder (5) on its upper end, the lower shoulder (5), when mounted, having a feed opening (8) with a tongue (9) extending downwards; characterized by the characteristics of claim 47.

49. A transport and storage system pursuant to claim 47, characterized by the lower shoulder (5) having a second tongue (40) mounted directly opposite the first tongue (9) and which extends upwards into the plane of the upper shoulder (4).

50. A transport and storage system pursuant to claim 49, characterized by the second tongue (40) being connected to the upper shoulder (4) in one piece.

51. A transport and storage system pursuant to claim 50, characterized by a restraining device attached to the lower shoulder (5) of the second tongue (40), preferably in the form of a groove (40').

52. A transport and storage system pursuant to claim 51, characterized by an edge protection and non-slip apparatus (60) that is attached by means of a connecting element.

53. A transport and storage system pursuant to claim 52, characterized by the edge protection and non-slip apparatus (60) being a plate (61) with an edge groove (36, 37) that protrudes on both sides beyond a plane which includes the plate (61).

54. A transport and storage system pursuant to claim 53, characterized by the unit consisting of the mounting apparatus (2) and support footings (3) having at least one reinforcement runner (65) that connects any number of support footings (3) or a stabilization plate that connects all support footings (3) that is removably mounted.

55. A transport and storage system pursuant to claim 54, characterized by a plurality of bolt fasteners (29) being provided to attach a corresponding plurality of runners and/or plates (28), the fasteners (66) being mounted in the feed opening of the support footings (3).

56. A transport and storage system pursuant to claim 24, characterized by the lower shoulder (5) having a second tongue (40) which extends upwardly from a base portion thereof located in the plane of the lower shoulder with the base portions of the first and second tongues being mounted directly opposite one another, the second tongue extending upwardly into an upper plane which includes the upper shoulder (4).

57. A transport and storage system pursuant to claim 1, characterized by a unit consisting of the mounting arrangement (2) and support footings (3) having at least one reinforcement runner (65) that connects any number of support footings (3) or a stabilization plate that connects all support footings (3) that is removably mounted.

58. A transport and storage system pursuant to claim 57, characterized by a plurality of bolt fasteners (29) being provided to attach a corresponding plurality of runners and/or plates (28), the fasteners (66) being mounted in the feed opening of the support footings (3).

59. Transport and storage system (1) comprising:

a goods mounting system (2); and a support system for the goods mounting system having;

at least one support footing (3) having an upper end and a lower end, and a connection device in the form of an upper outwardly extending shoulder (4) and a lower outwardly extending shoulder (5) on the upper end, the lower shoulder having a feed opening (8) and a downwardly pointing tongue, the upper shoulder (4) having at least one flexible lip (10, 11)in an area above the feed opening (8), wherein the flexible lip (10, 11) can be flexed from a plane which contains the upper shoulder (4), wherein the shoulders (4, 5) are made as annular shaped edge strips running parallel to each other with each lip (10, 11) being formed by a slot (12) which runs radially outwardly from the support footing (3), and by another slot (13, 14) which runs along an interior load side (16) of the upper shoulder (4).

* * * * *